US008515603B2

(12) United States Patent
Shinogi et al.

(10) Patent No.: US 8,515,603 B2
(45) Date of Patent: Aug. 20, 2013

(54) ANTITHEFT APPARATUS FOR EQUIPMENT WITH PRIME MOVER

(75) Inventors: Yoshihisa Shinogi, Wako (JP); Masato Takeda, Wako (JP); Kosei Yamashita, Wako (JP); Makoto Yamamura, Wako (JP); Masashi Manita, Wako (JP); Yoshinori Maekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 443 days.

(21) Appl. No.: 12/960,916

(22) Filed: Dec. 6, 2010

(65) Prior Publication Data

US 2011/0137500 A1 Jun. 9, 2011

(30) Foreign Application Priority Data

Dec. 9, 2009 (JP) ..... 2009-279929

(51) Int. Cl.
*B63H 21/22* (2006.01)

(52) U.S. Cl.
USPC ..... 701/21; 701/36; 701/32.6; 180/287

(58) Field of Classification Search
USPC ..... 701/21, 36, 112, 115, 32.6; 440/1; 340/5.6, 5.61; 180/287
See application file for complete search history.

(56) References Cited

U.S. PATENT DOCUMENTS

| | | | | |
|---|---|---|---|---|
| 6,077,133 | A | 6/2000 | Kojima et al. | |
| 8,357,018 | B2 * | 1/2013 | Takeda et al. | 440/1 |
| 2005/0099265 | A1 * | 5/2005 | Dix et al. | 340/5.72 |

FOREIGN PATENT DOCUMENTS

| | | | |
|---|---|---|---|
| EP | 1288411 | A2 | 3/2003 |
| EP | 1 724 167 | A1 | 11/2006 |
| JP | 2001-206199 | A | 7/2001 |
| JP | 2005-248710 | A | 9/2005 |
| JP | 2006-142880 | A | 6/2006 |
| JP | 2007-090908 | A | 4/2007 |
| JP | 2007-106346 | A | 4/2007 |
| JP | 2008-207602 | A | 9/2008 |
| JP | 2010-048200 | A | 3/2010 |
| KP | 2009-196406 | A | 9/2009 |

OTHER PUBLICATIONS

Office Action issued in Japanese Patent Application No. JP-2009-279929, mailed Oct. 24, 2012, 4 pages.

* cited by examiner

*Primary Examiner* — Richard M. Camby
(74) *Attorney, Agent, or Firm* — Arent Fox LLP

(57) ABSTRACT

In an apparatus for preventing theft of equipment such as outboard motor having a prime mover (engine), a prime mover controller and an authenticator (26) that acquires ID information from an electronic key when the key is brought close thereto by an operator and gives a permission to the prime mover controller to start the prime mover when acquired ID information is determined to correspond with authentication ID information, the permission was given is stored, and the authenticator determines whether the information is stored each time when activated (S12), and gives the permission to the prime mover controller immediately when it is determined that it is stored (S32), thereby enabling to easily restart the prime mover without authentication operation.

10 Claims, 3 Drawing Sheets

ANTITHEFT APPARATUS FOR EQUIPMENT WITH PRIME MOVER

BACKGROUND OF THE INVENTION

1. Field of the Invention

This invention relates to an antitheft apparatus for equipment with a prime mover.

2. Description of the Related

Conventionally, an antitheft apparatus (so-called an "immobilizer") for equipment like a vehicle having a prime mover is known which, when an electronic key storing ID information is manipulated by the operator, sends the ID information to an immobilizer controller to verify it with authentication ID information, and only when the authentication is verified (the ID information is valid), allows the prime mover to be started with the electronic key, thereby preventing theft, as taught, for example, by Japanese Laid-Open Patent Application No. 2007-90908.

SUMMARY OF THE INVENTION

However, in the equipment frequently and repeatedly started and stopped, it is necessary for the operator to conduct authentication operation every time the equipment is started and it is bothersome. Specifically, in the case where the equipment comprises an outboard motor which is mounted on a boat to be used for fishing, usually the prime mover is stopped in a fishing spot and started to move to another fishing spot. Since the prime mover is frequently started and stopped, it is extremely troublesome to conduct the authentication operation every time the prime mover is started.

An object of this invention is therefore to overcome the aforesaid problem by providing an antitheft apparatus for equipment with a prime mover that, when the prime mover is frequently and repeatedly started and stopped, enables to easily restart the prime mover without authentication operation.

In order to achieve the object, this invention provides in its first aspect an apparatus for preventing theft of equipment having a prime mover, a prime mover controller that controls operation of the prime mover, and an authenticator that acquires ID information from an electronic key when the key is brought close thereto by an operator, determines whether the acquired ID information corresponds with authentication ID information, and gives permission to the prime mover controller to start the prime mover when the acquired ID information is determined to correspond with the authentication ID information, comprising a memorizer that stores information that the permission was given to the prime mover controller to start the prime mover; wherein the authenticator determines whether the information is stored each time when activated, and gives the permission to the prime mover controller immediately when it is determined that the information is stored.

In order to achieve the object, this invention provides in its second aspect a method for preventing theft of equipment having a prime mover, a prime mover controller that controls operation of the prime mover, and an authentication comprising the steps of acquiring ID information from an electronic key when the key is brought close thereto by an operator, determining whether the acquired ID information corresponds with authentication ID information, and giving permission to the prime mover controller to start the prime mover when the acquired ID information is determined to correspond with the authentication ID information, comprising the steps of: storing information that the permission was given to the prime mover controller to start the prime mover; and determining whether the information is stored each time when activated (S12), and giving the permission to the prime mover controller immediately when it is determined that the information is stored.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An antitheft apparatus for equipment with a prime mover according to an embodiment of the invention will now be explained with reference to the attached drawings.

Figure 1:
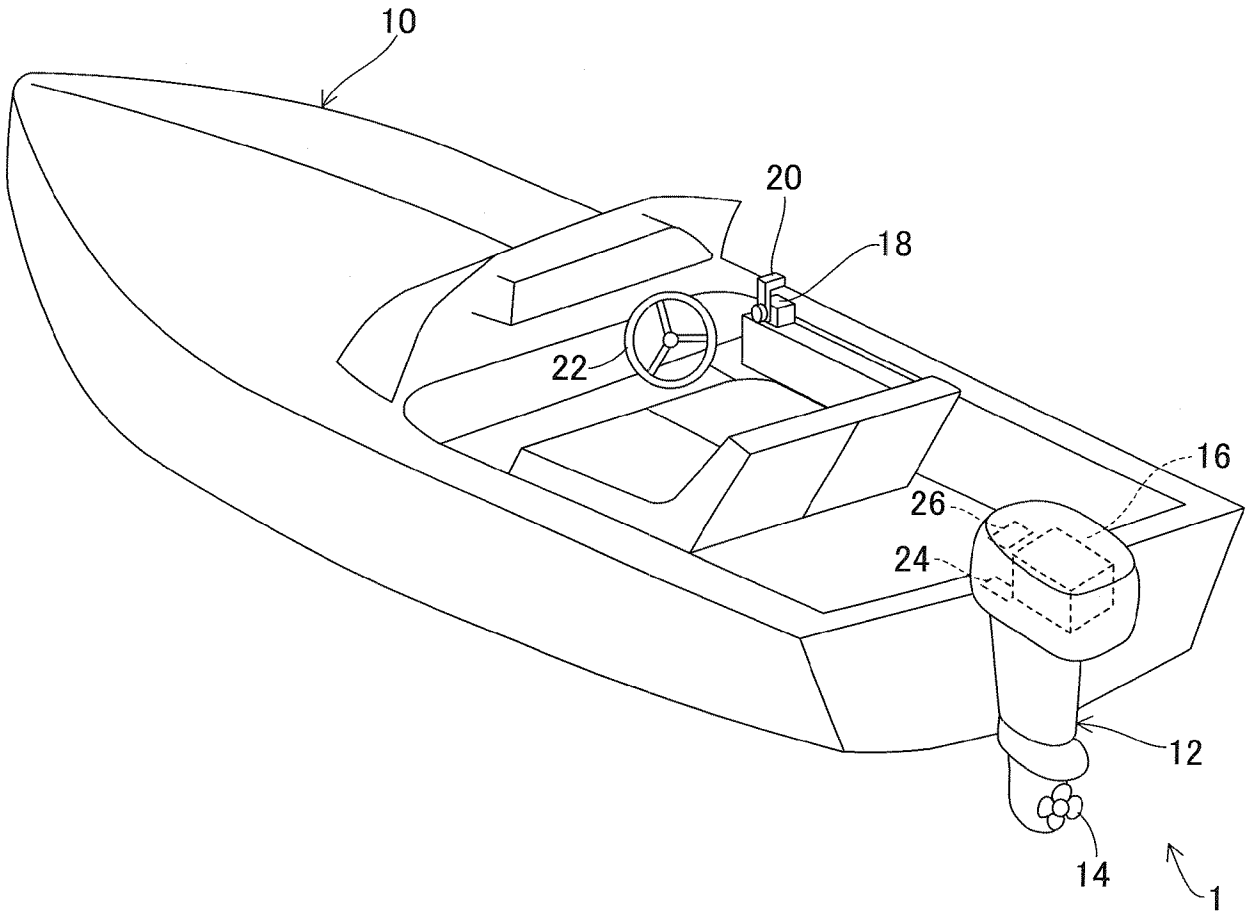
FIG. 1 is an overall schematic view of an antitheft apparatus for equipment with a prime mover including a boat (hull) according to an embodiment of the invention.

FIG. 1 is an overall schematic view of an antitheft apparatus for equipment with a prime mover including a boat (hull) according to an embodiment of the invention In FIG. 1, reference numeral 1 indicates the antitheft apparatus for equipment with a prime mover. In the following, the explanation will be made by taking an outboard motor mounted with an internal combustion engine as an example of the equipment with a prime mover. As shown in FIG. 1, the outboard motor 12 is clamped (fastened) to the stern or transom of a boat (hull) 10.

The outboard motor 12 is equipped with a propeller 14 and internal combustion engine (prime mover) 16. The propeller 14 is rotated by power transmitted from the engine 16 and produces thrust for propelling the boat 10. The engine 16 comprises a spark-ignition gasoline engine with a displacement of 2,200 cc. The engine 16 is located above the water surface and covered by an engine cover.

A remote control box 18 is installed near a cockpit or operator's seat of the boat 10. The remote control box 18 is equipped with a lever 20 to be operable by the operator. The lever 20 can be moved (swung) fore and aft, i.e., toward and away from the operator from its initial position, by which the operator can input shift (gear) position commands and engine speed regulation commands. A lever position sensor (not shown) is installed near the lever 20 and produces an output or signal corresponding to a position of the operated lever 20.

A steering wheel 22 is installed near the cockpit to be rotatably manipulated. The operator manipulates the steering wheel 22 to input steering or turning commands. A steering angle sensor (not shown) is installed at a rotary shaft of the steering wheel 22 and produces an output or signal indicative of steering angle of the steering wheel 22.

The outboard motor 12 is installed near the engine 16 with an Electronic Control Unit (hereinafter called the "engine ECU" or "prime mover controller") 24 that controls the operation of the engine 16 and other components of the outboard motor 12. The engine ECU 24 comprises a microcomputer having a CPU, ROM, memory, input/output circuit and the like. The outputs of the forgoing sensors are inputted to the engine ECU 24. Based on the inputted outputs, the engine ECU 24 controls the operation of the engine 16 and other components of the outboard motor 12 in accordance with programs stored in the ROM.

Details of the outboard motor are described in Japanese Laid-Open Patent Application No. 2006-142880 proposed by the applicant earlier and the further explanation is omitted here.

The outboard motor 12 is also installed near the engine ECU 24 with other Electronic Control Unit (hereinafter called the "authentication ECU" or "authenticator") 26 that performs authentication check of an electronic key so as to prevent the outboard motor from theft. The authentication ECU 26 similarly comprises a microcomputer having a CPU, ROM, memory, input/output circuit and the like. Upon the manipulation of the electronic key, the authentication ECU 26 acquires ID information stored in the key, determines whether the ID acquired information corresponds with authentication ID information of the outboard motor 12, and when they are determined to correspond with each other, allows the engine 16 of the outboard motor 12 to start.

The engine ECU 24 and authentication ECU 26 are activated upon the supply of power from a battery disposed in the outboard motor 12 or the boat 10.

Figure 2:
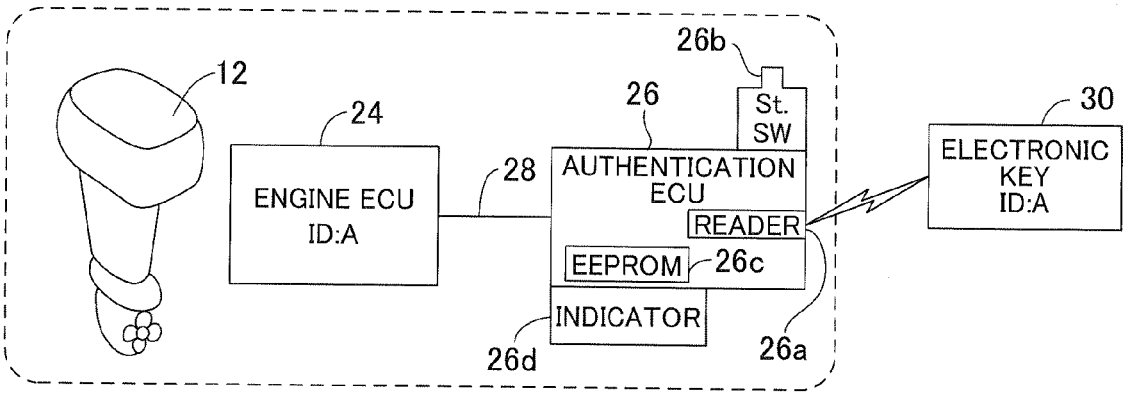
FIG. 2 is a block diagram showing the configuration of the apparatus shown in FIG. 1.

FIG. 2 is a block diagram showing the configuration of the engine ECU 24 and authentication ECU 26 of the outboard motor 12.

In the outboard motor 12, the engine ECU 24 and authentication ECU 26 are interconnected to communicate with each other by a communication line 28. The engine ECU 24 stores ID information A (authentication ID information; indicated by "ID: A" in the drawing) used to identify the engine 16 of the outboard motor 12. The ID information comprises a string of several characters.

A card-shaped electronic key 30 for the outboard motor 12 stores the ID information A (indicated by "ID: A") which is the same as that stored in the engine ECU 24.

The authentication ECU 26 is equipped with a reader 26*a*. When the key 30 is brought close to the authentication ECU 26 of the outboard motor 12 by the operator, the authentication ECU 26 can acquire the ID information A from the key 30 through the reader 26*a* by wireless communication (more precisely, the contactless-type short-distance wireless communication). The authentication ECU 26 verifies the acquired ID information A of the key 30 with the ID information A of the engine 16 of the outboard motor 12 sent through the communication line 28.

In this case, since the above two data of the ID information A correspond with each other, the authentication ECU 26 sends an enable signal to the engine ECU 24, whereby the engine ECU 24 makes the engine 16 ready for start, more exactly, enables the ignition. Under this condition, when a starter switch 26*b* associated with the authentication ECU 26 is made ON, the engine 16 is started.

The aforementioned memory of the authentication ECU 26 includes a non-volatile memory (indicated as "EEPROM" in FIG. 2; memorizer) 26*c* capable of keeping stored information even when the power is OFF. When the engine 16 is enabled or allowed to start (which will be mentioned later), the memory 26*c* stores the information indicating that the engine start is enabled. The authentication ECU 26 further comprises an indicator 26*d* having an LED (Light-Emitting Diode), etc., that is lit when the engine start enabled information is stored in the memory 26*c*.

On the other hand, when the authentication ECU 26 determines in its authentication operation that the ID information acquired from an electronic key does not correspond with the ID information A of the engine 16, the authentication ECU 26 does not send the enable signal to the engine ECU 24. Consequently, since the ignition position is not established, even when the starter switch 26*b* is made ON, the engine 16 is not started.

Thus, the outboard motor 12 is configured such that, when the authentication ECU 26 determines that the ID information A in the key 30 corresponds with the authentication ID information A in the engine ECU 24, the engine start is enabled or allowed and when the two data of ID information do not correspond with each other, the engine start is disabled, thereby preventing theft of the outboard motor 12 and the boat 10.

The apparatus 1 according to this embodiment is characterized in that, when once the authentication for starting the engine 16 is verified, the engine start enabled condition is maintained. In the following, more details of the operation of the apparatus 1 will be explained.

Figure 3:
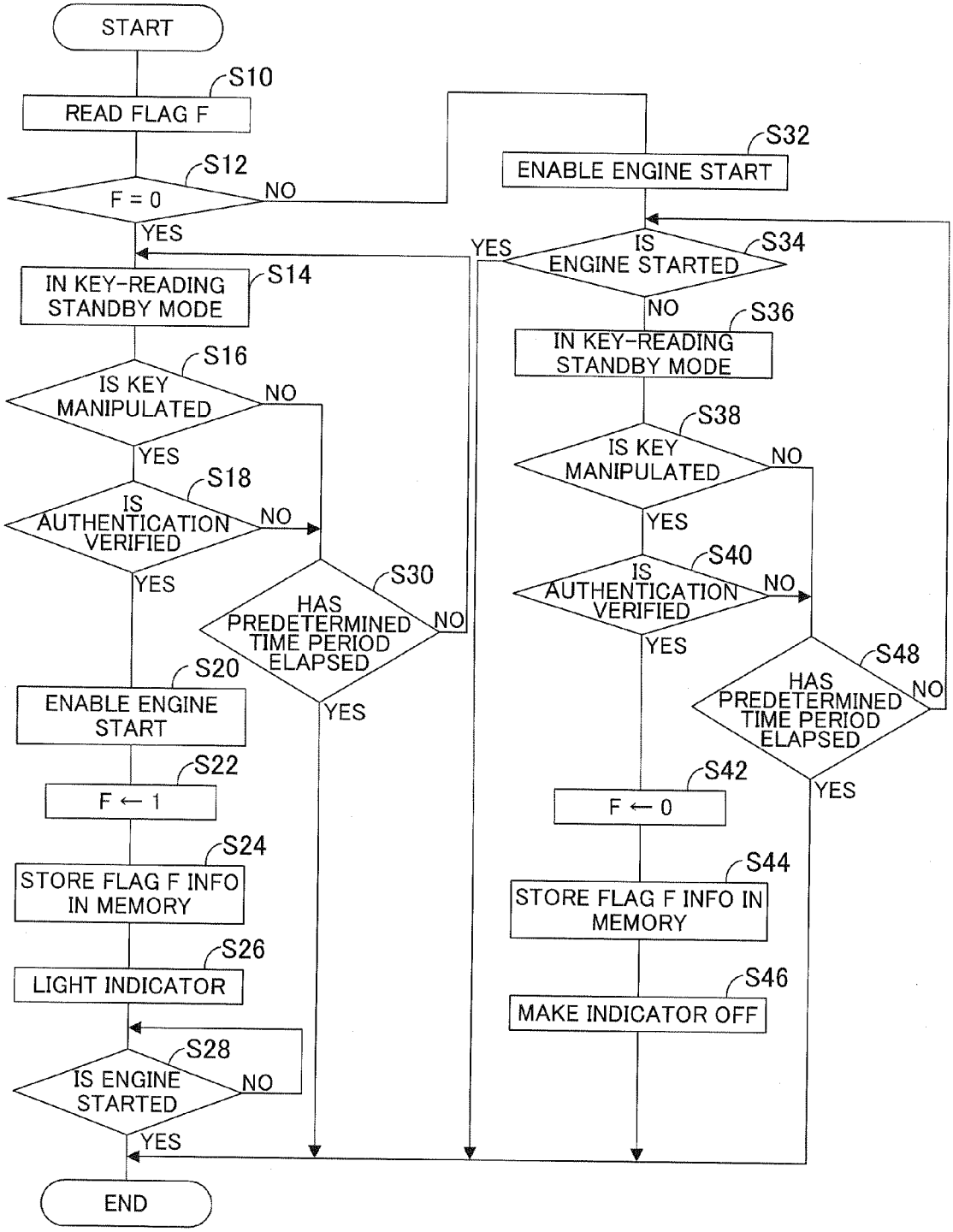
FIG. 3 is a flowchart showing the operation of the apparatus shown in FIG. 2.

FIG. 3 is a flowchart showing the operation of the apparatus 1. The illustrated program is executed by the authentication ECU 26 when the authentication ECU 26 is supplied with power.

The program begins at S10, in which a flag F (explained later) is read from the memory 26*c* and proceeds to S12, in which it is determined whether a bit of the flag F is 0. Since a bit of the flag F is initially set to 0, the result in S12 in the first program loop is affirmative and the program proceeds to S14, in which the status is changed to a key-reading standby mode.

Next, in S16, it is determined whether the key 30 is manipulated near (brought close to) the reader 26*a* by the operator. When the result in S16 is affirmative, the program proceeds to S18, in which it is determined whether the authentication is verified. Specifically, as mentioned above, upon the manipulation of the key 30, the ID information of the key 30 is acquired and it is determined whether the acquired ID information corresponds with the authentication ID information of the engine 16.

When the result in S18 is affirmative, the program proceeds to S20, in which the engine 16 is enabled or allowed to start, i.e., the engine start enable signal is sent to the engine ECU 24. In other words, a permission is given to the prime mover controller to start the prime mover when the acquired ID information is determined to correspond with the authentication ID information (S20).

The program proceeds to S22, in which a bit of the flag F is set to 1 and to S24, in which information about the flag F is stored in the memory 26*c*. The information about the flag F being set to 1 eventually means information indicating that the engine start is enabled.

The program proceeds to S26, in which the indicator 26*d* is lit. This is done to inform the operator that the authentication has been verified in S18 and the engine 16 was enabled to start, i.e., it is under the condition where the antitheft function through the authentication ECU 26 is not active.

Next, the program proceeds to S28, it is determined whether the engine 16 is started, i.e., whether the starter switch 26*b* is made ON. When the result in S28 is affirmative, the program is terminated and the authentication ECU 26 is made OFF. However, since the indicator 26*d* is continuously supplied with power, it remains lit.

When the result in S16 or S18 is negative, the program proceeds to S30, in which it is determined whether a predetermined time period (e.g., 30 seconds) has elapsed since the authentication ECU 26 was activated. When the result in S30 is negative, the program returns to S14, while, when the result is affirmative, the program is terminated and the authentication ECU 26 is made OFF.

In the case where the authentication ECU 26 is activated with a bit of the flag F being set to 1 as explained, in S10, the flag F (whose bit is 1) is read and the program proceeds to S12 to determine whether a bit of the flag F is 0. Since the result in S12 is naturally negative, the program proceeds to S32, in which the engine 16 is enabled to start.

Specifically, in this case, the authentication ECU 26 sends the engine start enabled signal to the engine ECU 24 without authenticating the key 30. Thus, the authenticator (26) determines whether the information is stored each time when activated (S12), and gives the permission to the prime mover controller immediately when it is determined that the information is stored (S32).

The program proceeds to S34, in which it is determined whether the engine 16 is started, i.e., whether the starter switch 26*b* is made ON. When the result in S34 is affirmative, the program is terminated and the authentication ECU 26 is made OFF.

When the result in S34 is negative, the program proceeds to S36, in which the status is changed to the key-reading standby mode.

Next, in S38, it is determined whether the key 30 is manipulated near the reader 26*a*. When the result in S38 is affirmative, the program proceeds to S40, in which it is determined whether the authentication is verified. Specifically, as mentioned above, upon the manipulation of the key 30, the ID information of the key 30 is acquired and it is determined whether the acquired ID information corresponds with the authentication ID information of the engine 16.

When the result in S40 is affirmative, the program proceeds to S42, in which a bit of the flag F is reset to 0 (i.e., the information is erased when the acquired ID information is determined to correspond with the authentication ID information). The program then proceeds to S44, in which information about the flag F is stored in the memory 26*c*, and to S46, in which the indicator 26*d* is made OFF.

To be more specific, when the authentication is verified again under the condition where a bit of the flag F is set to 1 (i.e., the engine start enabled information is stored), the authentication ECU 26 is restored to the initial condition (where the antitheft function is active). Further, the indicator 26*d* is used to inform the operator that the authentication ECU 26 is in the initial condition.

Then the program is terminated and the authentication ECU 26 is made OFF.

When the result in S38 or S40 is negative, the program proceeds to S48, in which it is determined whether a predetermined time period (e.g., 30 seconds) has elapsed since the authentication ECU 26 was activated. When the result in S48 is negative, the program returns to S34, while, when the result is affirmative, the program is terminated and the authentication ECU 26 is made OFF.

As stated above, the embodiment is configured to have an apparatus and method for preventing theft of equipment (outboard motor 12) having a prime mover (internal combustion engine 16), a prime mover controller (engine ECU 24) that controls operation of the prime mover, and an authenticator (authentication ECU 26) that acquires ID information from an electronic key (30) when the key is brought close thereto by an operator (S16), determines whether the acquired ID information corresponds with authentication ID information (S18), and gives permission to the prime mover controller to start the prime mover when the acquired ID information is determined to correspond with the authentication ID information (S20), characterized in that: a memorizer (EEPROM 26*c*) that stores information (or data) that the permission was given to the prime mover controller to start the prime mover (S24); and the authenticator determines whether the information is stored each time when activated (S12), and gives the permission to the prime mover controller immediately when it is determined that the information is stored (S32).

Specifically, when once the authentication for starting the prime mover (engine 16) is verified, the condition that the prime mover start is enabled is maintained. With this, even in the case where the prime mover is frequently and repeatedly started and stopped, it is not necessary to conduct the authentication operation every time the prime mover is started, thereby easily restarting the prime mover.

Further, in a case that the equipment is the outboard motor 12, even if the electronic key 30 is lost at sea, the operator can restart the prime mover and avoid manually rowing the boat.

In the apparatus and method, the authenticator acquires the ID information from an electronic key (30) when the key is brought close thereto by an operator (S38), determines whether the acquired ID information corresponds with authentication ID information (S40), and erases the information when the acquired ID information is determined to correspond with the authentication ID information (S42).

Specifically, since the key 30 for the equipment is also used to reset the prime mover start enabled condition, it becomes possible to appropriately restore the antitheft function.

The apparatus and method further includes: an indicator (26*d*) installed in the authenticator (26), and the indicator is turned on when the information is kept stored in the memorizer (S26).

With this, it becomes possible to easily know whether the antitheft function of the equipment is currently active.

In the apparatus and method, the equipment comprises an outboard motor (12), and the prime mover comprises an internal combustion engine (16).

It should be noted that although, in the foregoing, one outboard motor is mounted on the boat 10, the invention can also be applied to multiple outboard motor installations comprising two or more outboard motors.

Japanese Patent Application No. 2009-279929, filed on Dec. 9, 2009, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for preventing theft of equipment having a prime mover, a prime mover controller that controls operation of the prime mover, and an authenticator that acquires ID information from an electronic key when the key is brought close thereto by an operator, determines whether the acquired ID information corresponds with authentication ID information, and gives permission to the prime mover controller to start the prime mover when the acquired ID information is determined to correspond with the authentication ID information, comprising:

a memorizer that stores information that the permission was given to the prime mover controller to start the prime mover, wherein the authenticator determines whether the information is stored each time when activated, and gives the permission to the prime mover controller immediately when it is determined that the information is stored.

2. The apparatus according to claim 1, wherein the authenticator acquires the ID information from the electronic key when the key is brought close thereto by the operator, determines whether the acquired ID information corresponds with authentication ID information, and erases the information when the acquired ID information is determined to correspond with the authentication ID information.

3. The apparatus according to claim 1, further including:

an indicator installed in the authenticator, and the indicator is turned on when the information is kept stored in the memorizer.

4. The apparatus according to claim 1, wherein the equipment comprises an outboard motor.

5. The apparatus according to claim 4, wherein the prime mover comprises an internal combustion engine.

6. A method for preventing theft of equipment having a prime mover, a prime mover controller that controls operation of the prime mover, and an authentication comprising the steps of acquiring ID information from an electronic key when the key is brought close thereto by an operator, determining whether the acquired ID information corresponds with authentication ID information, and giving permission to the prime mover controller to start the prime mover when the acquired ID information is determined to correspond with the authentication ID information, comprising the steps of:

storing information that the permission was given to the prime mover controller to start the prime mover; and determining whether the information is stored each time when activated, and giving the permission to the prime mover controller immediately when it is determined that the information is stored.

7. The method according to claim 6, wherein the authentication acquires the ID information from an electronic key when the key is brought close thereto by the operator, determines whether the acquired ID information corresponds with authentication ID information, and erases the information when the acquired ID information is determined to correspond with the authentication ID information.

8. The method according to claim 6, further including the step of:

turning an indicator when the information is kept stored in the memorizer.

9. The method according to claim 6, wherein the equipment comprises an outboard motor.

10. The method according to claim 9, wherein the prime mover comprises an internal combustion engine.

* * * * *